US010311797B2

(12) United States Patent
In

(10) Patent No.: US 10,311,797 B2
(45) Date of Patent: Jun. 4, 2019

(54) DISPLAY PANEL FOR EMPLOYING AN EXTERNAL COMPENSATION TECHNIQUE AND DISPLAY DEVICE HAVING THE SAME

(71) Applicant: Samsung Display Co., Ltd., Yongin-si, Gyeonggi-do (KR)

(72) Inventor: Hai-Jung In, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 5 days.

(21) Appl. No.: 15/191,213

(22) Filed: Jun. 23, 2016

(65) Prior Publication Data

US 2017/0154578 A1 Jun. 1, 2017

(30) Foreign Application Priority Data

Dec. 1, 2015 (KR) ..... 10-2015-0169735

(51) Int. Cl.

| | |
|---|---|
| ***G09G 3/30*** | (2006.01) |
| ***G09G 3/32*** | (2016.01) |
| ***G09G 5/10*** | (2006.01) |
| ***G09G 3/3283*** | (2016.01) |
| ***G09G 3/3266*** | (2016.01) |
| ***G09G 3/3233*** | (2016.01) |

(52) U.S. Cl.

CPC ..... *G09G 3/3283* (2013.01); *G09G 3/3233* (2013.01); *G09G 3/3266* (2013.01); *G09G 2310/0272* (2013.01); *G09G 2320/0223* (2013.01); *G09G 2320/0233* (2013.01); *G09G 2320/0295* (2013.01); *G09G 2320/043* (2013.01)

(58) Field of Classification Search

CPC ..... G09G 3/3283; G09G 3/3291; G09G 2320/0233; G09G 3/3233; G09G 3/3266; G09G 2310/0272; G09G 2320/0295; G09G 2320/043

See application file for complete search history.

(56) References Cited

U.S. PATENT DOCUMENTS

| | | | | |
|---|---|---|---|---|
| 9,754,536 | B2 * | 9/2017 | Chang | G09G 3/3258 |
| 2011/0018858 | A1 * | 1/2011 | Ryu | G09G 3/3233 345/213 |
| 2011/0210958 | A1 * | 9/2011 | Yoo | G09G 3/325 345/214 |
| 2013/0050292 | A1 * | 2/2013 | Mizukoshi | G09G 3/3291 345/690 |
| 2014/0347253 | A1 * | 11/2014 | Lee | H05B 33/0896 345/76 |
| 2015/0179105 | A1 * | 6/2015 | Mizukoshi | G09G 3/3266 345/76 |
| 2017/0154579 | A1 * | 6/2017 | Choi | G09G 3/3291 |

FOREIGN PATENT DOCUMENTS

KR 10-2011-0028752 A 3/2011

* cited by examiner

*Primary Examiner* — Xuemei Zheng
(74) *Attorney, Agent, or Firm* — Lewis Roca Rothgerber Christie LLP

(57) ABSTRACT

A display panel includes a pad electrically connected to an external device, a data line electrically connected to the pad, a pixel at a crossing region of the data line, a feedback line, and a scan line, and a transferring circuit block configured to provide an initialization voltage to the feedback line in response to an initialization control signal, and configured to electrically connect the feedback line with the data line in response to a first sensing control signal.

18 Claims, 6 Drawing Sheets

DISPLAY PANEL FOR EMPLOYING AN EXTERNAL COMPENSATION TECHNIQUE AND DISPLAY DEVICE HAVING THE SAME

CROSS-REFERENCE TO RELATED APPLICATION

This application claims priority to, and the benefit of, Korean Patent Application No. 10-2015-0169735, filed on Dec. 1, 2015, the entire contents of which are incorporated herein by reference in their entirety.

BACKGROUND

1. Technical Field

The present disclosure herein relates to a display device, and to a display panel employing an external compensation technique.

2. Description of the Related Art

An organic light emitting display device may display an image using an organic light emitting diode. The organic light emitting display device may include pixels, which may include a driving transistor to transfer a driving current to an organic light emitting diode in response to a data voltage. However, luminance of pixels may be represented non-uniformly according to a different characteristic of the driving transistor for each of the pixels.

A conventional organic light emitting display device may include a sensing line for employing an external compensation technique (e.g., a technique to sense a characteristic of the driving transistor, to transfer the characteristic of the driving transistor to an external component, and to compensate the data voltage based on the characteristic of the driving transistor using the external component). However, a yield may be lowered according to a pad that is added corresponding to the sensing line, and a production cost may increase as a number of channels of the external component (e.g., a data driving integrated circuit) increases.

SUMMARY

Some example embodiments provide a display panel to improve a yield while employing an external compensation technique.

Some example embodiments provide a display device to reduce a production cost while employing an external compensation technique.

According to an embodiment a display panel includes a pad electrically connected to an external device, a data line electrically connected to the pad, a pixel at a crossing region of the data line, a feedback line, and a scan line, and a transferring circuit block configured to provide an initialization voltage to the feedback line in response to an initialization control signal, and configured to electrically connect the feedback line with the data line in response to a first sensing control signal.

The data line may be arranged in a first direction, and the feedback line may be substantially parallel to the data line, and may be spaced from the data line in a second direction.

The pixel may include a light emission element that is electrically connected between a first node and a second power voltage, a driving transistor including a first electrode for receiving a first power voltage, a second electrode electrically connected to the first node, and a gate electrode electrically connected to a second node, a switching transistor including a first electrode electrically connected to the data line, a second electrode electrically connected to the second node, and a gate electrode for receiving a scan signal, a storage capacitor electrically connected between the first node and the second node, and a sensing transistor including a first electrode electrically connected to the feedback line, a second electrode electrically connected to the first node, and a gate electrode for receiving a second sensing control signal.

The transferring circuit block may include a first transistor including a first electrode for receiving the initialization voltage, a second electrode electrically connected to the feedback line, and a gate electrode for receiving the initialization control signal, and a second transistor including a first electrode electrically connected to the feedback line, a second electrode electrically connected to the data line, and a gate electrode for receiving the first sensing control signal.

The first transistor may be configured to be turned on in a first display period, the second transistor may be configured to be turned off in the first display period, and a data signal may be configured to be provided to the pixel in the first display period.

The first transistor may be configured to be turned on in a second display period, the second transistor may be configured to be turned off in the second display period, and the pixel may be configured to emit a light based on the data signal in the second display period.

The first transistor may be configured to be turned on in a first sensing period, and turned off in a second sensing period, the second transistor may be configured to be turned off in the first sensing period, and turned on in the second sensing period, a sensing reference voltage may be configured to be provided to the pixel in the first sensing period, and a sensing signal generated by the pixel may be configured to be outputted to the external device based on the sensing reference voltage in the second sensing period.

According to an embodiment a display device includes a display panel including a pad, a data line electrically connected to the pad, a pixel at a crossing region of the data line, a feedback line, and a scan line, and a transferring circuit block configured to provide an initialization voltage to the feedback line in response to an initialization control signal, and to electrically connect the feedback line with the data line in response to a first sensing control signal, and a data driver configured to provide a data signal to the display panel through the pad in a first period, and to receive a sensing signal from the display panel through the pad in a second period.

The data driver may include a data writing block configured to generate the data signal, a sensing block configured to receive the sensing signal, and a switching block configured to electrically connect the data writing block or the sensing block with the pad.

The switching block may include a first switch electrically connected between the pad and the data writing block that is configured to be turned on in response to a first switch control signal, and a second switch electrically connected between the pad and the sensing block that is configured to be turned on in response to a second switch control signal.

The transferring circuit block includes a first transistor including a first electrode for receiving the initialization voltage, a second electrode electrically connected to the feedback line, and a gate electrode for receiving the initialization control signal, and a second transistor including a first electrode electrically connected to the feedback line, a second electrode electrically connected to the data line, and a gate electrode for receiving the first sensing control signal.

The pixel may include a light emission element that is electrically connected between a first node and a second power voltage, a driving transistor including a first electrode for receiving a first power voltage, a second electrode electrically connected to the first node, and a gate electrode electrically connected to a second node, a switching transistor including a first electrode electrically connected to the data line, a second electrode electrically connected to the second node, and a gate electrode for receiving a scan signal, a storage capacitor that is electrically connected between the first node and the second node, and a sensing transistor including a first electrode electrically connected to the feedback line, a second electrode electrically connected to the first node, and a gate electrode for receiving a second sensing control signal.

The first switch may be configured to be turned on in a first display period, the second switch may be configured to be turned off in the first display period, the first transistor may be configured to be turned on in the first display period, the second transistor may be configured to be turned off in the first display period, and a data signal may be configured to be provided to the pixel in the first display period.

The first transistor may be configured to be turned on in a first sensing period, and turned off in a second sensing period, the second transistor may be configured to be turned off in the first sensing period, and turned on in the second sensing period, a sensing reference voltage may be configured to be provided to the pixel in the first sensing period, and a sensing signal generated by the pixel may be configured to be outputted to an external device based on the sensing reference voltage in the second sensing period.

The first switch may be configured to be turned on in the first sensing period and, turned off in the second sensing period, and the second switch may be configured to be turned off in the first sensing period, and turned on in the second sensing period.

The data writing block may be configured to generate the sensing reference voltage in the first sensing period.

The first transistor may be configured to be turned on in a third sensing period, the second transistor may be configured to be turned on in the third sensing period, the third sensing period may be between the first sensing period and the second sensing period, and the feedback line and the data line may be configured to be initialized in the third sensing period.

The first switch may be configured to be turned off in the third sensing period, and the second switch may be configured to be turned on in the third sensing period.

The data driver may be configured to generate the initialization voltage, and provide the initialization voltage to the display panel.

A timing controller may be configured to generate the initialization control signal and the first sensing control signal.

BRIEF DESCRIPTION OF THE DRAWINGS

The accompanying drawings are included to provide a further understanding of embodiments of the inventive concept, and are incorporated in, and constitute a part of, this specification. The drawings illustrate embodiments of the inventive concept and, together with the description, serve to explain aspects of embodiments of the inventive concept. In the drawings.

DESCRIPTION OF EMBODIMENTS

Figure 1:
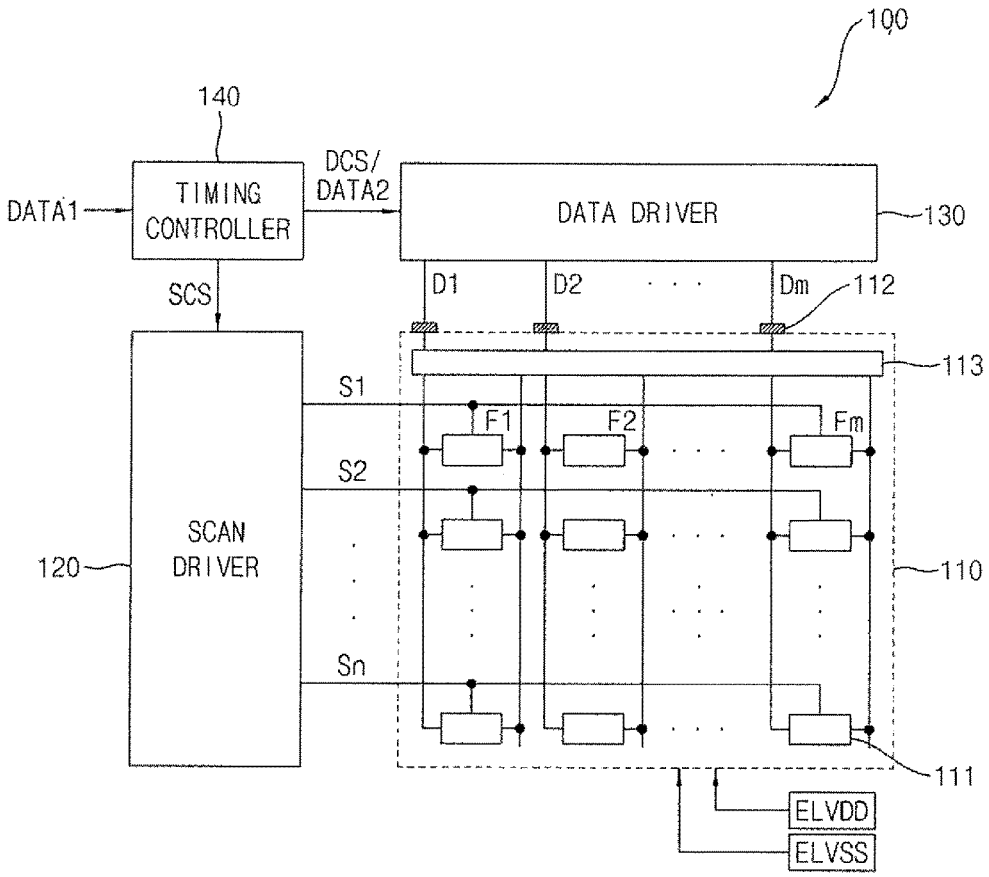
FIG. 1 is a block diagram illustrating a display device according to an embodiment.

Features of the inventive concept and methods of accomplishing the same may be understood more readily by reference to the following detailed description of embodiments and the accompanying drawings. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to an embodiment.

Referring to FIG. 1, the display device 100 may include a display panel 110, a scan driver 120, a data driver 130, and a timing controller 140.

The display device 100 may display an image based on image data provided from an outside or provided from an external device. As a non-limiting example, the display device 100 may be an organic light emitting display device. The display device 100 may employ an external compensation technique. Here, the external compensation technique to sense a characteristic of a pixel 111 (e.g., information of a threshold voltage/mobility of a driving transistor included in the pixel 111), to transfer the characteristic of the pixel 111 to an external device (e.g., to a data driver 130), and to compensate image data/a data signal based on the characteristic of the pixel 111 sensed by the external device.

The display panel 110 may include a pad(s) 112, scan lines S1 through Sn, data lines D1 through Dm, feedback lines F1 through Fm, a pixel 111, and a transferring circuit block 113, where each of m and n is an integer that is greater than or equal to 2.

The pad 112 may be electrically connected to the external device (e.g., the data driver 130) and may transfer a signal between the external device and the display panel 110. The data lines D1 through Dm may be electrically connected to the pad 112. The pixel 111 may be at cross regions of the scan lines S1 through Sn and the data lines D1 through Dm.

The pixel 111 may store a data signal in response to a scan signal, and may emit a light based on the stored data signal. In addition, the pixel 111 may sense a characteristic of the pixel 111 (e.g., a threshold voltage of a driving transistor included in the pixel 111), and may output the characteristic of the pixel 111. A configuration of the pixel 111 will be described in detail with reference to FIG. 3.

The transferring circuit block 113 may form a path/a sensing signal flowing path to transfer a sensing signal, which may include information of the characteristic of the pixel 111, to the external device using the data lines D1 through Dm. The transferring circuit block 113 may provide an initialization voltage to the feedback lines F1 through Fm in response to an initialization control signal, and may respectively electrically connect the feedback lines F1 through Fm with the data lines D1 through Dm in response to a first sensing control signal. Here, the initialization control signal and the first sensing control signal may be provided form the timing controller 140. In addition, the initialization voltage may be generated by the data driver 130, and may have a certain voltage level.

The scan driver 120 may generate the scan signal based on the scan driving control signal SCS. The scan driving control signal SCS may be provided from the timing controller 140 to the scan driver 120. The scan driving control signal SCS may include a start pulse and/or clock signals, and the scan driver 120 may include a shift register for sequentially generating the scan signal corresponding to the start pulse and the clock signals.

The data driver 130 may generate the data signal based on image data (e.g., second data DATA2), may provide the data signal to the display panel 110/to the pixel 111, and may receive the sensing signal from the display panel 110. The data driver 130 may provide the display panel 110 with the data signal generated based on a data driving control signal DCS. Here, the data driving control signal DCS may be provided from the timing controller 140 to the data driver 130.

In some embodiments, the data driver 130 may provide the data signal to the display panel 110 through the pad 112 during a display period (e.g., a first period), and may receive the sensing signal from the display panel 110 through the pad 112 during a sensing period (e.g., a second period). Here, the first period may be a display period in which the pixel 111 emits a light in response to the data signal. The second period may be a sensing period for sensing the characteristic of the pixel 111. That is, the display device 100 may perform a sensing operation to sense the characteristic of the pixel 111. The second period may be different from the first period.

The data driver 130 may provide the data signal, or may receive the sensing signal, by employing a time-division driving technique. A configuration of the data driver 130 will be described in detail with reference to FIG. 3.

The timing controller 140 may control the scan driver 120 and the data driver 130. The timing controller 140 may generate the scan driving control signal SCS, the data driving control signal DCS, the initialization control signal, and the first sensing control signal. The timing controller 140 may also control the scan driver 120 and the data driver 130 based on generated signals.

In some embodiments, the timing controller 140 may generate compensation data to compensate a characteristic variation (e.g., a variation of information of threshold voltage/mobility of the driving transistor) of the pixel 111 based on the sensing signal that is transferred through the data driver 130. The timing controller 140 may include a memory device to store the compensation data (e.g., predetermined/pre-calculated compensation data), and may revise/update the compensation data stored in the memory device. The timing controller 140 may convert first data DATA1 into second data DATA2 based on the compensation data, and may provide the second data DATA2 to the data driver 130.

The display device 100 may include a power supply. The power supply may generate a driving voltage/a power voltage to drive the display device 100. The driving voltage may include a first power voltage ELVDD and a second power voltage ELVSS. The first power voltage ELVDD may be higher than the second power voltage ELVSS.

As described above, the display device 100 according to an embodiment may form the path/sensing signal flowing path, which transfers the sensing signal generated by the pixel 111, using the data lines D1 through Dm. In this case, the display device 100 may not need pads 112 to electrically connect the data driver 130 with the feedback lines F1 through Fm. Therefore, the display device 100 may reduce the number of the pads 112 used, and may improve yield. In addition, the display device 100 may reduce a number of channels of the data driver 130, and may reduce production cost by including the data driver 130 that provides the data signal or that receives the sensing signal employing the time-division driving technique.

Figure 2:
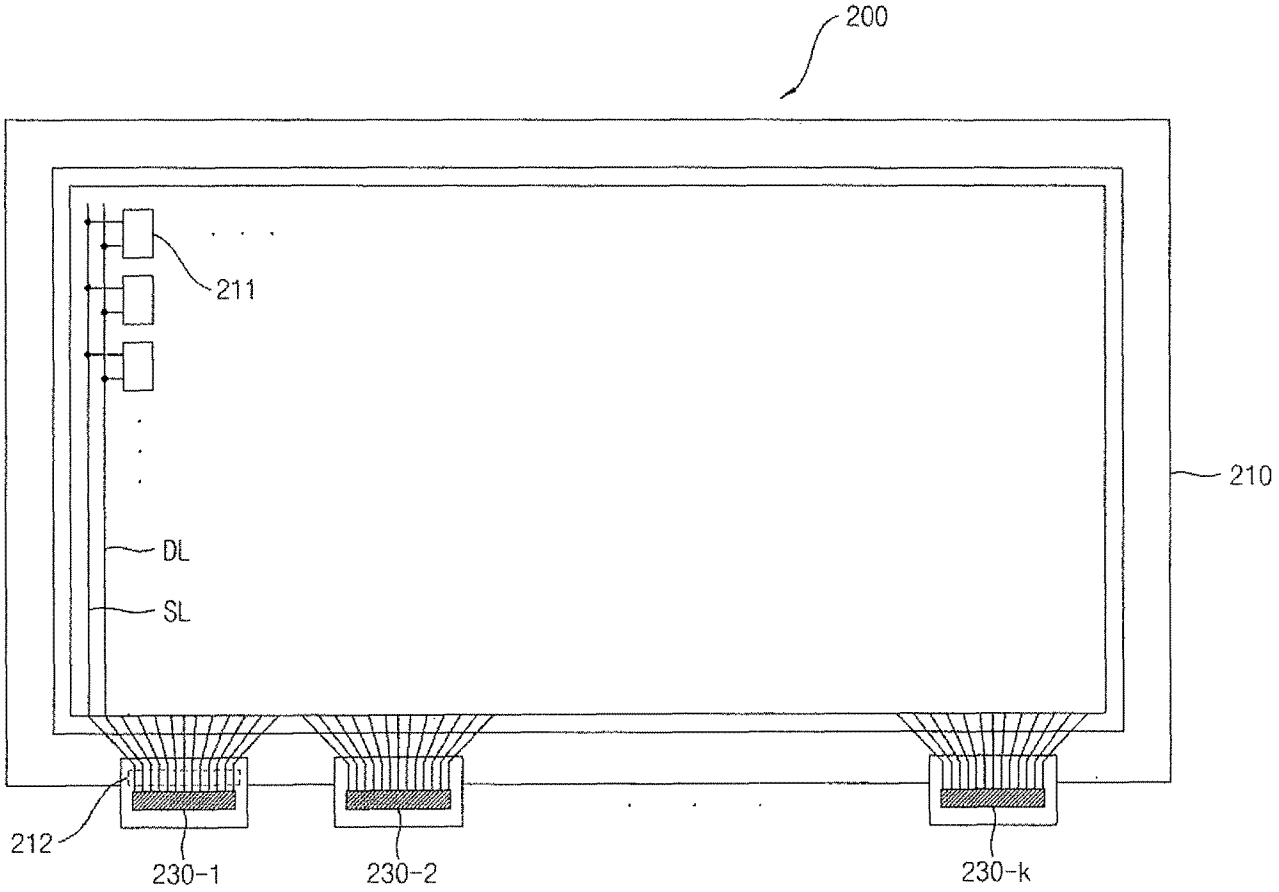
FIG. 2 is a block diagram illustrating a comparative example of the display device of FIG. 1.

FIG. 2 is a block diagram illustrating a comparative example of the display device of FIG. 1.

Referring to FIG. 2, the display device 200 may include a display panel 210 and data driving units 230-1 through **230-*k*, where k is an integer greater than or equal to 2. The display panel 210 may include a sensing line SL, a data line DL, a pixel 211, and a pad block 212 that electrically connects the data driving units 230-1 through 230-*k*** with the sensing line SL and the data line DL.

The data line DL may transfer the data signal from the data driving units 230-1 through **230-*k* to the display panel 210, and may transfer a sensing signal (e.g., a sensing signal including information of a threshold voltage of a driving transistor included in the pixel 211) that is sensed by the pixel 211 to the data driving units 230-1 through 230-*k*. Each of the data driving units 230-1 through 230-*k*** may generate the data signal, and may receive the sensing signal.

The pad block 212 may include pads, where a number of the pads may be greater than, or equal to, a sum of a number of sensing lines SL and a number of data lines DL. As a non-limiting example, when one pixel row includes 1024 pixels, the number of sensing lines SL may be 1024, and the number of the data lines DL may be 1024. In this case, the number of pads of the pad block 212 may be greater than, or equal to, 2048, which is the total number of sensing lines SL and data lines DL.

A number of channels of the data driving units 230-1 through **230-*k* may be equal to a number of the pads 112. As a non-limiting example, the data driving units 230-1 through 230-*k* may use 2048 channels to drive the 1024 pixels, and to receive sensing signal from the 1024 pixels, and each of the data driving units 230-1 through 230-*k*** may include "2048/k" number of channels.

The display device 200 may include a greater number of pads than the number of the pads 112 included in the display device 100 of FIG. 1. As a non-limiting example, there may be twice as many pads 112. Further a pitch/a distance between the pads may be narrower than the pitch between the pads 112 illustrated in FIG. 1. Therefore, a fault or a short opening of the pads may occur more easily or more often, and a yield of the display device 200 may be lower than a yield of the display device 100. In addition, a production cost of the display device 200 may be greater than a production cost of the display device 100 of FIG. 1. Because the display device 200 may include a greater number of channels than the data driver 130 included in the display device 100 of FIG. 1 (e.g., twice as many), the display device 200 may use the data driving units 230-1 through **230-*k***, which may include many channels.

Accordingly, the display device 100 according to an embodiment may improve yield, and may reduce production cost, by reducing the number of the pads 112 and channels of the data driver 130 (as compared to the display device 200 of the embodiment shown in FIG. 2).

Figure 3:
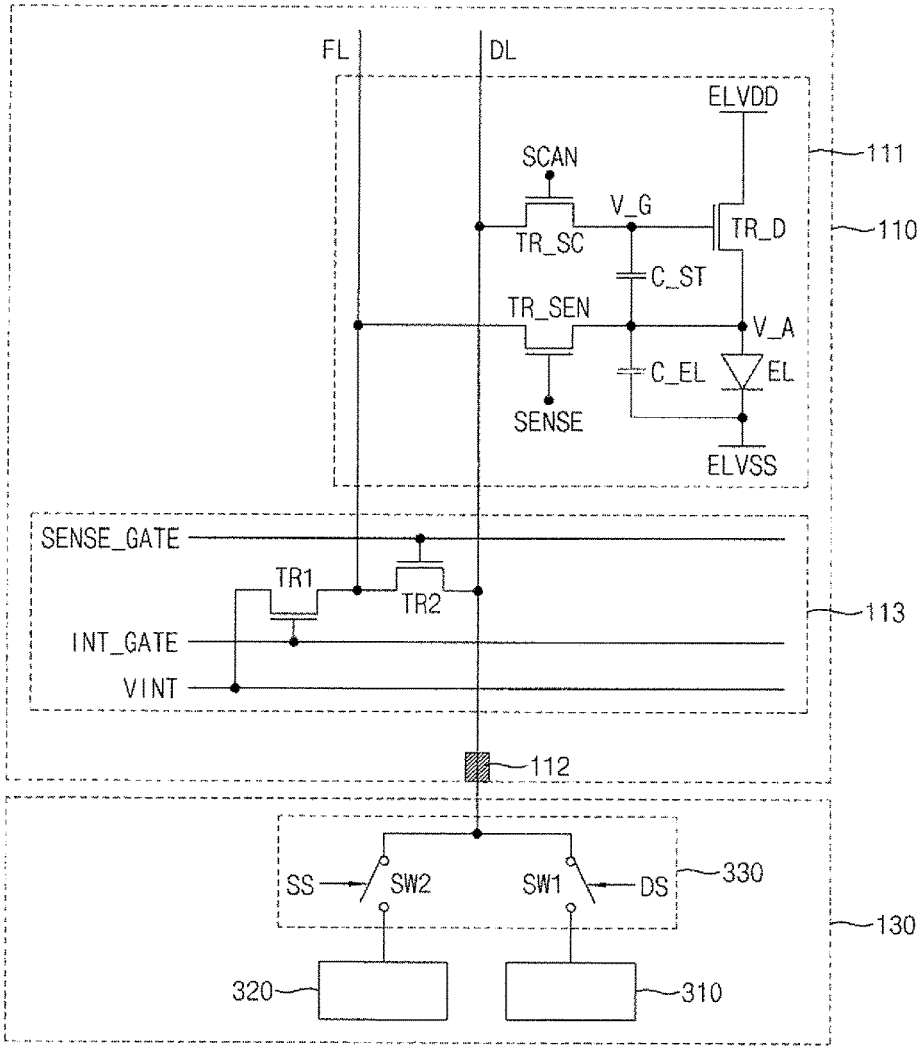
FIG. 3 is a diagram illustrating an example of a display panel and a data driver included in the display device of FIG. 1.

FIG. 3 is a diagram illustrating examples of a display panel and a data driver included in the display device of FIG. 1.

Referring to FIG. 3, the display panel 110 may include the pixel 111, the pad 112, and the transferring circuit block 113. The display panel 110 may include a data line DL and a feedback line FL. The data line DL may extend in a first direction, and the feedback line FL may be spaced from the data line DL along a second direction, and may extend in parallel to the data line DL, where the second direction is substantially perpendicular to the first direction. The feedback line FL and the data line DL may be arranged to correspond to the pixel 111.

The pixel 111 may include a light emission element EL, a driving transistor TR_D, a switching transistor TR_SC, a storage capacitor C_ST, and a sensing transistor TR_SEN.

The light emission element EL may be electrically connected between a first node, which has a first node voltage V_A, and the second power voltage ELVSS. The light emission element EL may emit a light based on a driving current that is transferred through the driving transistor TR_D. The light emission element EL may be an organic light emitting diode.

The driving transistor TR_D may include a first electrode, which receives the first power voltage ELVDD, a second electrode, which is electrically connected to the first node, and a gate electrode which is electrically connected to a second node, which has a second node voltage V_G. The driving transistor TR_D may transfer the driving current to the light emission element EL in response to the second node voltage V_G at the second node.

The switching transistor TR_SC may include a first electrode that is electrically connected to the data line DL, a second electrode that is electrically connected to the second node, and a gate electrode that is configured to receive a scan signal SCAN. The switching transistor TR_SC may provide the second node with a data voltage/data signal from the data line DL in response to the scan signal SCAN.

The storage capacitor C_ST may be electrically connected between the first node and the second node. The storage capacitor C_ST may temporally store the data voltage provided through the switching transistor TR_SC.

The sensing transistor TR_SEN may include a first electrode that is electrically connected to the feedback line FL, a second electrode that is electrically connected to the first node, and a gate electrode that receives a second sensing control signal SENSE. The sensing transistor TR_SEN may provide an initialization voltage VINT to the first node in response to the second sensing signal SENSE, or may provide the feedback line FL with the first node voltage V_A at the first node. Here, the first node voltage V_A may convey information of a characteristic of the pixel 111 (e.g., information of a characteristic of the driving transistor TR_D).

The pixel 111 may emit a light based on the data voltage provided through the data line DL, and may output the information of the characteristic of the pixel 111 through the feedback line FL. Operations (e.g., a light emission operation and a sensing operation) of the pixel 111 will be described in detail with reference to FIGS. 4A through 4C.

The pad 112 may electrically connect the data line DL with the data driver 130. The pad 112 may be included in the display panel 110 corresponding to the pixel 111 (or, corresponding to a pixel column). The pad 112 may provide the data voltage from the data driver 130 to the data line DL, and may transfer the information of the characteristic of the pixel 111 (e.g., the sensing signal) from the pixel 111 to the data driver 130.

As described with reference to FIG. 1, the transferring circuit block 113 may provide the initialization voltage VINT to the pixel 111, and may form the path/the sensing signal flowing path to transfer the information of the characteristic of the pixel 111 (or to transfer the sensing signal) to the pad 112.

The transferring circuit block 113 may include a first transistor TR1 and a second transistor TR2. The first transistor TR1 may include a first electrode that receives the initialization voltage VINT, a second electrode that is electrically connected to the feedback line FL, and a gate electrode that receives an initialization control signal INT_GATE. The first transistor TR1 may transfer the initialization voltage VINT to the feedback line FL in response to the initialization control signal INT_GATE. The second transistor TR2 may include a first electrode that is electrically connected to the feedback line FL, a second electrode that is electrically connected to the data line DL, and a gate electrode that receives a first sensing control signal SENSE_GATE. The second transistor TR2 may electrically connect the feedback line FL with the data line DL in response to the first sensing control signal SENSE_GATE. In this case, the sensing signal may be transferred to the pad 112 through the feedback line FL and the data line DL.

In some embodiments, the transferring circuit block 113 may be adjacent the pad 112. The transferring circuit block 113 may be between the pad 112 and a pixel region in which the pixel 111 is located.

The initialization voltage VINT may be generated by the data driver 130, and may be provided to the display panel 110. An initialization voltage line to transfer the initialization voltage VINT may extend in the second direction. The initialization voltage VINT may be commonly provided to other pixels. The initialization control signal INT_GATE and the first sensing control signal SENSE_GATE may be generated by the timing controller 140, and may be provided to the display panel 110.

The data driver 130 may include a data writing block 310, a sensing block 320, and a switching block 330.

The data writing block 310 may generate the data signal/data voltage. As a non-limiting example, the data writing block 310 may include a gamma voltage generating circuit to generate the data voltage (e.g., a grayscale voltage) corresponding to image data provided from the timing controller 140.

The sensing block 320 may receive the sensing signal. As a non-limiting example, the sensing block 320 may receive a feedback current (e.g., feedback or a sensing current) from the display panel 110, and may include an analog-digital convertor to generate sensing data by integrating the feedback current.

The switching block 330 may electrically connect one of the data writing block 310 and the sensing block 320 to the pad 112. The switching block 330 may include a first switch SW1 and a second switch SW2. The first switch SW1 may be electrically connected between the pad 112 and the data writing block 310, and may be turned on in response to a first switch control signal DS. The second switch SW2 may be electrically connected between the pad 112 and the sensing block 320, and may be turned on in response to a second switch control signal SS. Here, the first switch control signal DS and the second switch control signal SS may be generated by the timing controller 140.

As described above, the display panel 110 may include the pad 112 corresponding to the pixel 111 (or corresponding to a pixel column), and may include the transferring circuit block 113 to transfer the sensing signal to the data driver 130 through the pad 112. Therefore, the display panel 110 may not require an extra pad for employing the external compensating technique. The display panel 110 may have enough pitch between the pad 112, and may reduce a fault (e.g., a short, an open, etc.) that occurs between pads/within the pad 112. In addition, a production cost of the display panel 110 may be reduced, and a yield of the display panel 110 may be improved.

It is illustrated in FIG. 3, by way of example, that each of the transistors TR_D, TR_SC, TR_SEN, TR1, and TR2 included in the display panel 110 is an N-type transistor. However the transistors are not limited thereto the transistors may be P-type transistors in other embodiments.

Hereinafter, an operation (e.g., a display operation and a sensing operation) of the display device 100 will be described in detail with reference to FIGS. 4A through 4C.

Figure 4A:
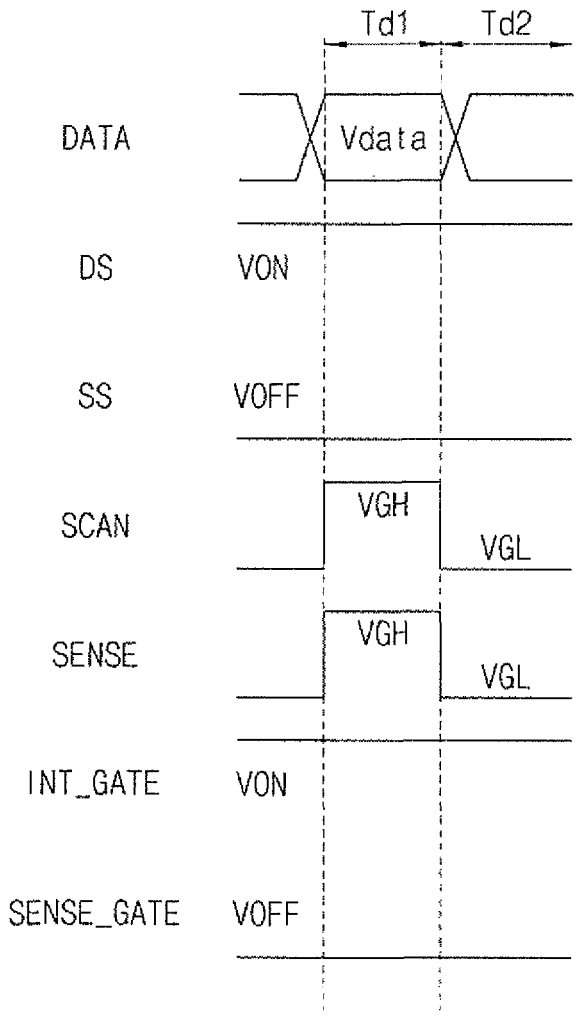
FIG. 4A is a waveform diagram for describing an example of a display operation of the display device of FIG. 1.

FIG. 4A is a waveform diagram for describing an example of a display operation of the display device of FIG. 1.

Referring to FIGS. 3 and 4A, a first period (e.g., a display period) may include a first display period Td1 and a second display period Td2. The data signal/the data voltage may be provided to the pixel 111 in the first display period Td1, and the pixel 111 may emit a light based on the data signal in the second display period Td2. Here, the first display period Td1 may be different to, or might not overlap, the second display period Td2.

In the first display period Td1, the data signal DATA may have a data voltage Vdata. Here, the data voltage Vdata may be a grayscale value corresponding to a certain grayscale. The data signal DATA may be generated by the data writing block 310.

The first switch control signal DS may have a turn-on voltage VON, which may be a high voltage or a logic high level, and the second switch control signal SS may have a turn-off voltage VOFF, which may be a low voltage or a logic low level. In this case, the first switch SW1 may be turned on, and the pad 112 may be electrically connected to the data writing block 310. The second switch SW2 may be turned off. Therefore, the data voltage Vdata may be provided from the data driver 130 to the display panel 110.

The scan signal SCAN may have a logic high level VGH/a high voltage/a turn-on voltage. In this case, the switching transistor TR_SC may be turned on, and the pixel 111 may store the data voltage Vdata into the storage capacitor C_ST.

The second sensing control signal SENSE may have the logic high level VGH, the initialization control signal INT_GATE may have the turn-on voltage VON, and the first sensing control signal SENSE_GATE may have the turn-off voltage VOFF. In this case, the first transistor TR1 may be turned on, and the sensing transistor TR_SEN may be turned on. Therefore, the pixel 111 may provide the initialization voltage VINT to the first node. Because a parasitic capacitor/parasitic capacitance C_EL of the light emission element EL may be charged according to the initialization voltage VINT, an effectiveness of the parasitic capacitor C_EL to the data voltage Vdata may be reduced or eliminated. Here, the initialization voltage VINT may be lower than, or equal to, a threshold voltage of the light emission element EL. Therefore, the pixel 111 may emit no light even though the data voltage Vdata is provided.

That is, in the first display period Td1, the data driver 130 may provide the data voltage Vdata to the pixel 111 through the data line DL, and the pixel 111 may store the data voltage Vdata.

In the second display period Td2, the scan signal SCAN and the second sensing control signal SENSE may have a logic low level VGL (e.g., a low voltage, the turn-off voltage). In this case, the switching transistor TR_SC and the sensing transistor TR_SEN may be turned off. Therefore, the pixel 111 may emit a light based on the data voltage Vdata that is stored in the storage capacitor C_ST.

The initialization control signal INT_GATE may have the turn-on voltage VON, and the first sensing control signal SENSE_GATE may have the turn-off voltage VOFF. Therefore, the first transistor TR1 may be turned on, and the second transistor TR2 may be turned off.

As described above, in the first period (e.g., during the display period), the display device 100 may provide the data signal from the data driver 130 through the data line DL to the pixel 111, and the pixel 111 may emit a light in response to the data signal/data voltage Vdata.

Figure 4B:
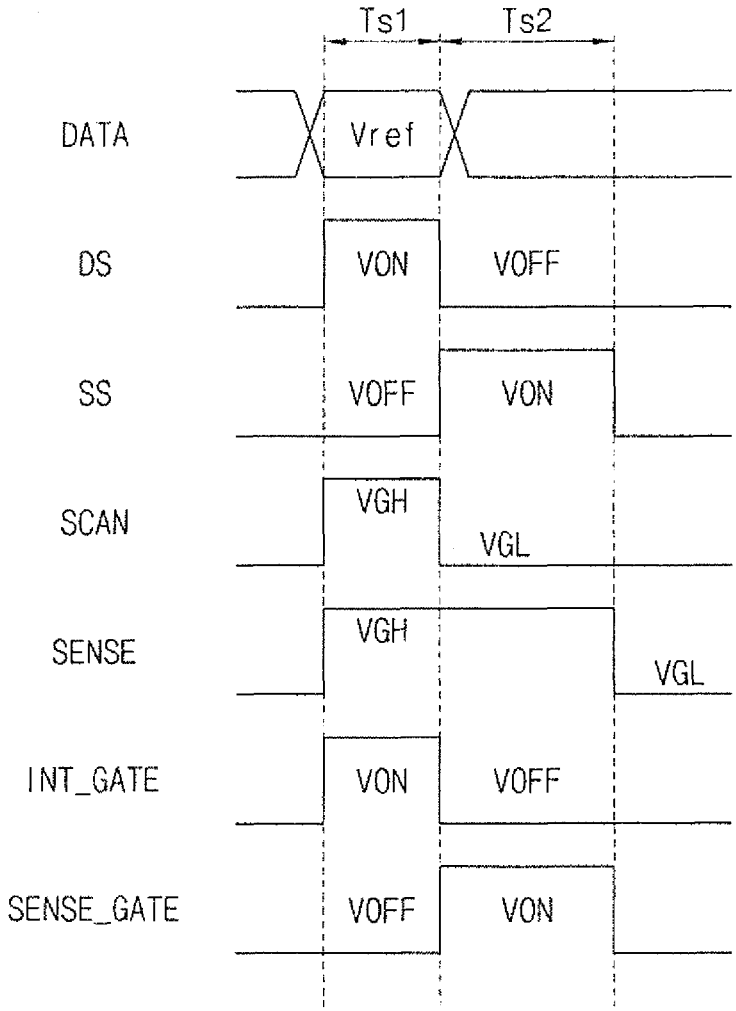
FIG. 4B is a waveform diagram for describing an example of a sensing operation of the display device of FIG. 1.

FIG. 4B is a waveform diagram for describing an example of a sensing operation of the display device of FIG. 1.

Referring to FIGS. 3 and 4B, a second period (e.g., a sensing period) may include a first sensing period Ts1 and a second sensing period Ts2. Here, a sensing reference voltage Vref may be provided to the pixel 111 in the first sensing period Ts1, and the sensing signal, which is generated based on the sensing reference voltage Vref, may be outputted to the external device (e.g., the data driver 130). The first sensing period Ts1 may be different from, or might not overlap, the second sensing period Ts2.

In the first sensing period Ts1, the data signal DATA may have the sensing reference voltage Vref. Here, the sensing reference voltage Vref may have a voltage level (e.g., a predetermined voltage level). The sensing reference voltage Vref may be generated by the data writing block 310.

In the first sensing period Ts1, the first switch control signal DS may have the turn-on voltage VON, and the second switch control signal SS may have the turn-off voltage VOFF. In this case, the first switch SW1 may be turned on, and the second switch SW2 may be turned off. Therefore, the sensing reference voltage Vref, which is generated by the data writing block 310, may be provided to the display panel 110 through the pad 112.

The scan signal SCAN and the second sensing control signal SENSE may have the logic high level VGH, the initialization control signal INT_GATE may have the turn-on voltage VON, and the second sensing control signal SENSE_GATE may have the turn-off voltage VOFF. In this case, the first transistor TR1 may be turned on, and the sensing transistor TR_SEN may be turned off. Therefore, the initialization voltage VINT may be provided to the first node. The switching transistor TR_SC may be turned on, and the sensing reference voltage Vref, which is transferred through the data line DL, may be store in the storage capacitor C_ST.

That is, in the first sensing period Ts1, the data driver 130 may provide the sensing reference voltage Vref to the pixel 111 through the data line DL, and the pixel 111 may store the sensing reference voltage Vref in a manner that is similar to an operation of the display device 100 in the first display period Td1 described with reference to FIG. 4A.

In the second sensing period Ts2, the scan signal SCAN may have the logic low level VGL, the second sensing control signal SENSE may have the logic high level VGH, the initialization control signal INT_GATE may have the turn-off voltage VOFF, and the first sensing control signal SENSE_GATE may have the turn-on voltage VON. In this case, the first transistor TR1 may be turned off, and the initialization voltage VINT may not be provided to the first node (i.e., a supplying of the initialization voltage VINT to the first node may be stopped). The driving transistor TR_D may provide the sensing current (or, the driving current) to the first node in response to the sensing reference voltage Vref that is stored in the storage capacitor C_ST. Because the sensing transistor TR_SEN and the second transistor TR2 are turned on, the path (or, the sensing signal flowing path) may be formed through the first node, the feedback line FL, the data line DL, and the pad 112. Therefore, the sensing current may be transferred to the data driver 130 (or, the sensing block 320) through the path.

As described above, in the second period (or, the sensing period), the display device 100 may provide the sensing reference voltage Vref from the data writing block 310 of the data driver 130 through the data line DL to the pixel 111, the pixel 111 may output the sensing current in response to the sensing reference voltage Vref, and the sensing current may be transferred to the sensing block 320 of the data driver 130 through the path/the sensing signal flowing path (e.g., a path formed through the second transistor TR2 and the second switch SW2).

As described with reference to FIGS. 4A and 4B, the display device 100 according to an embodiment may perform a display operation and a sensing operation using the pad 112.

Figure 4C:
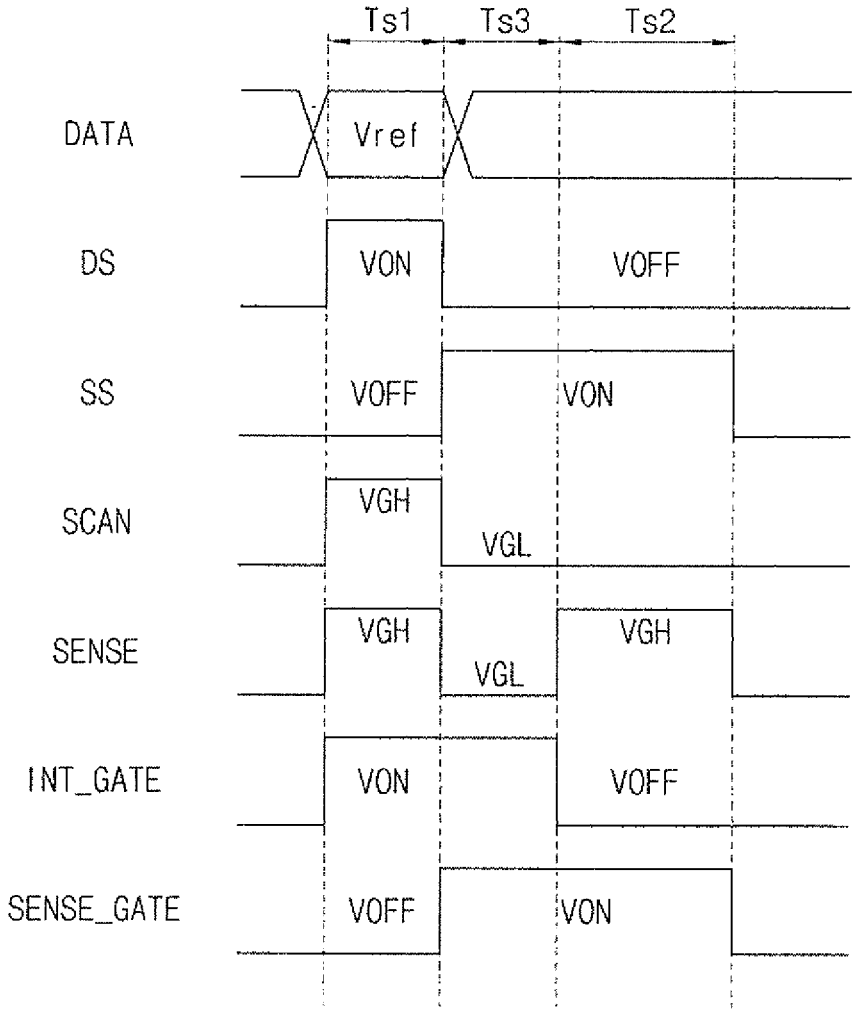
FIG. 4C is a waveform diagram for describing another example of a sensing operation of the display device of FIG. 1.

FIG. 4C is a waveform diagram for describing another embodiment of a sensing operation of the display device of FIG. 1.

Referring to FIGS. 3, 4B, and 4C, the second period/sensing period may include the first sensing period Ts1, the second sensing period Ts2, and a third sensing period Ts3. An operation of the display device 100 in the first sensing period Ts1 may be substantially the same as an operation of the display device 100 in the first sensing period Ts1 described with reference to FIG. 4B. In addition, an operation of the display device 100 in the second sensing period Ts2 may be substantially the same as an operation of the display device 100 in the second sensing period Ts2 described with reference to FIG. 4B. Therefore, duplicated descriptions will not be repeated.

The third period Ts3 may be between the first sensing period Ts1 and the second sensing period Ts2, and the feedback line FL and the data line DL may be initialized in the third period T3.

In the third period Ts3, the second switch control signal SS may have the turn-on voltage VON, the initialization control signal INT_GATE may have the turn-on voltage VON, and the first sensing control signal SENSE_GATE may have the turn-on voltage VON. In this case, the second switch SW2 may be turned on, the first transistor TR1 may be turned on, the second transistor TR2 may be turned on, and each of the data line DL and the feedback line FL may be respectively initialized to have the initialization voltage VINT. Therefore, a sensing noise (e.g., an error of the sensing signal due to a delay of the initialization voltage VINT) may be reduced or eliminated, and the display device 100 may improve accuracy of the external compensation.

The present inventive concept may be applied to any display device (e.g., an organic light emitting display device, a liquid crystal display device, etc.) including an emission driver. As a non-limiting example, the present inventive concept may be applied to a television, a computer monitor, a laptop, a digital camera, a cellular phone, a smart phone, a personal digital assistant (PDA), a portable multimedia player (PMP), an MP3 player, a navigation system, a video phone, etc.

The foregoing is illustrative of embodiments, and is not to be construed as limiting thereof. Although a few embodiments have been described, those skilled in the art will readily appreciate that many modifications are possible in the embodiments without materially departing from the novel teachings and advantages of embodiments. Accordingly, all such modifications are intended to be included within the scope of embodiments as defined in the claims. In the claims, means-plus-function clauses are intended to cover the structures described herein as performing the recited function and not only structural equivalents but also equivalent structures. Therefore, it is to be understood that the foregoing is illustrative of embodiments and is not to be construed as limited to the specific embodiments disclosed, and that modifications to the disclosed embodiments, as well as other embodiments, are intended to be included within the scope of the appended claims. The inventive concept is defined by the following claims, with equivalents of the claims to be included therein.

What is claimed is:

1. A display panel comprising:

a pad electrically connected to an external device;

a data line electrically connected to the pad;

a pixel at a crossing region of the data line, a feedback line, and a scan line; and a transferring circuit block configured to provide an initialization voltage to the feedback line in response to an initialization control signal, and configured to electrically connect the feedback line with the pad via the data line in response to a first sensing control signal, wherein the data line is directly connected to the pad without an intervening switch between the data line and the pad, and is directly connected to the pixel without an intervening switch between the data line and the pixel, and wherein the transferring circuit block comprises:

a first transistor comprising:

a first electrode for receiving the initialization voltage;

a second electrode electrically connected to the feedback line; and a gate electrode for receiving the initialization control signal; and a second transistor comprising:

a first electrode electrically connected to the feedback line;

a second electrode electrically connected to the data line; and a gate electrode for receiving the first sensing control signal.

2. The display panel of claim 1, wherein the data line is arranged in a first direction, and wherein the feedback line is substantially parallel to the data line, and is spaced from the data line in a second direction.

3. The display panel of claim 1, wherein the pixel comprises:

a light emission element that is electrically connected between a first node and a second power voltage;

a driving transistor comprising:

a first electrode for receiving a first power voltage;

a second electrode electrically connected to the first node; and a gate electrode electrically connected to a second node;

a switching transistor comprising:

a first electrode electrically connected to the data line;

a second electrode electrically connected to the second node; and a gate electrode for receiving a scan signal;

a storage capacitor that is electrically connected between the first node and the second node; and a sensing transistor comprising:

a first electrode electrically connected to the feedback line;

a second electrode electrically connected to the first node; and a gate electrode for receiving a second sensing control signal.

4. The display panel of claim 1, wherein the first transistor is configured to be turned on in a first display period, wherein the second transistor is configured to be turned off in the first display period, and wherein a data signal is configured to be provided to the pixel in the first display period.

5. The display panel of claim 4, wherein the first transistor is configured to be turned on in a second display period, wherein the second transistor is configured to be turned off in the second display period, and wherein the pixel is configured to emit a light based on the data signal in the second display period.

6. The display panel of claim 1, wherein the first transistor is configured to be turned on in a first sensing period, and turned off in a second sensing period, wherein the second transistor is configured to be turned off in the first sensing period, and turned on in the second sensing period, wherein a sensing reference voltage is configured to be provided to the pixel in the first sensing period, and wherein a sensing signal generated by the pixel is configured to be outputted to the external device based on the sensing reference voltage in the second sensing period.

7. A display device comprising:

a display panel comprising:

a pad;

a data line electrically connected to the pad;

a pixel at a crossing region of the data line, a feedback line, and a scan line; and a transferring circuit block configured to provide an initialization voltage to the feedback line in response to an initialization control signal, and to electrically connect the feedback line with the pad via the data line in response to a first sensing control signal; and a data driver configured to provide a data signal to the display panel through the pad in a first period, and to receive a sensing signal from the display panel through the pad in a second period, wherein the data line is directly connected to the pad without an intervening switch between the data line and the pad, and is directly connected to the pixel without an intervening switch between the data line and the pixel, and wherein the transferring circuit block comprises:

a first transistor comprising:

a first electrode for receiving the initialization voltage;

a second electrode electrically connected to the feedback line; and a gate electrode for receiving the initialization control signal; and a second transistor comprising:

a first electrode electrically connected to the feedback line;

a second electrode electrically connected to the data line; and a gate electrode for receiving the first sensing control signal.

8. The display device of claim 7, wherein the data driver comprises:

a data writing block configured to generate the data signal;

a sensing block configured to receive the sensing signal; and a switching block configured to electrically connect the data writing block or the sensing block with the pad.

9. The display device of claim 8, wherein the switching block comprises:

a first switch electrically connected between the pad and the data writing block that is configured to be turned on in response to a first switch control signal; and a second switch electrically connected between the pad and the sensing block that is configured to be turned on in response to a second switch control signal.

10. The display device of claim 9, wherein the first switch is configured to be turned on in a first display period, wherein the second switch is configured to be turned off in the first display period, wherein the first transistor is configured to be turned on in the first display period, wherein the second transistor is configured to be turned off in the first display period, and wherein a data signal is configured to be provided to the pixel in the first display period.

11. The display device of claim 9, wherein the first transistor is configured to be turned on in a first sensing period, and turned off in a second sensing period, wherein the second transistor is configured to be turned off in the first sensing period, and turned on in the second sensing period, wherein a sensing reference voltage is configured to be provided to the pixel in the first sensing period, and wherein a sensing signal generated by the pixel is configured to be outputted to an external device based on the sensing reference voltage in the second sensing period.

12. The display device of claim 11, wherein the first switch is configured to be turned on in the first sensing period and, turned off in the second sensing period, and wherein the second switch is configured to be turned off in the first sensing period, and turned on in the second sensing period.

13. The display device of claim 11, wherein the data writing block is configured to generate the sensing reference voltage in the first sensing period.

14. The display device of claim 11, wherein the first transistor is configured to be turned on in a third sensing period, wherein the second transistor is configured to be turned on in the third sensing period, wherein the third sensing period is between the first sensing period and the second sensing period, and wherein the feedback line and the data line are configured to be initialized in the third sensing period.

15. The display device of claim 14, wherein the first switch is configured to be turned off in the third sensing period, and wherein the second switch is configured to be turned on in the third sensing period.

16. The display device of claim 7, wherein the pixel comprises:

a light emission element that is electrically connected between a first node and a second power voltage;

a driving transistor comprising:

a first electrode for receiving a first power voltage;

a second electrode electrically connected to the first node; and a gate electrode electrically connected to a second node;

a switching transistor comprising:

a first electrode electrically connected to the data line;

a second electrode electrically connected to the second node; and a gate electrode for receiving a scan signal;

a storage capacitor that is electrically connected between the first node and the second node; and a sensing transistor comprising:

a first electrode electrically connected to the feedback line;

a second electrode electrically connected to the first node; and a gate electrode for receiving a second sensing control signal.

17. The display device of claim 7, wherein the data driver is configured to generate the initialization voltage, and provide the initialization voltage to the display panel.

18. The display device of claim 7, further comprising a timing controller configured to generate the initialization control signal and the first sensing control signal.

* * * * *